US012404617B2

(12) United States Patent
Ronchi

(10) Patent No.: US 12,404,617 B2
(45) Date of Patent: Sep. 2, 2025

(54) MULTI-SECTION APPARATUS FOR DYEING, IN AN INERT ENVIRONMENT, OF FABRICS AND YARNS, WITH INDIGO AND OTHER REDUCTION DYES

(71) Applicant: MASTER S.R.L., Macherio (IT)

(72) Inventor: Francesco Ronchi, Sovico (IT)

(73) Assignee: MASTER S.R.L., Macherio (IT)

( * ) Notice: Subject to any disclaimer, the term of this patent is extended or adjusted under 35 U.S.C. 154(b) by 196 days.

(21) Appl. No.: 18/039,138

(22) PCT Filed: Nov. 24, 2021

(86) PCT No.: PCT/IB2021/060919

§ 371 (c)(1),
(2) Date: May 26, 2023

(87) PCT Pub. No.: WO2022/118146

PCT Pub. Date: Jun. 9, 2022

(65) Prior Publication Data

US 2023/0416984 A1 Dec. 28, 2023

(30) Foreign Application Priority Data

Dec. 1, 2020 (IT) ..... 102020000029285

(51) Int. Cl.
*D06B 5/06* (2006.01)
*D06B 1/02* (2006.01)
(Continued)

(52) U.S. Cl.
CPC ..... *D06B 5/06* (2013.01); *D06B 1/02* (2013.01); *D06B 3/04* (2013.01); *D06B 3/18* (2013.01);
(Continued)

(58) Field of Classification Search
CPC ... D06B 1/02; D06B 3/04; D06B 3/18; D06B 5/06; D06B 5/08; D06B 13/00;
(Continued)

(56) References Cited

U.S. PATENT DOCUMENTS 3,665,734 A * 5/1972 Hauser ..... D06B 21/00 68/18 F
4,818,244 A * 4/1989 Iwami ..... D06B 13/00 8/149.1
(Continued)

FOREIGN PATENT DOCUMENTS

EP 0275348 A1 7/1988
EP 1771617 A1 4/2007
(Continued)

*Primary Examiner* — Joseph L. Perrin
(74) *Attorney, Agent, or Firm* — Andrew D. Dorisio; Dickinson Wright PLLC

(57) ABSTRACT

A description is provided of an apparatus for dyeing a textile support comprising a single tank which is provided in its interior, in sequence, with: one first shaped cavity having a watertight function between the surrounding environment and the tank; one first internal partition wall, which is immersed in the lower part in the dye bath of the first shaped cavity for helping the watertight function; one first dyeing compartment and at least one second dyeing compartment which each comprise at least one return roller for the textile support, at least one dispensing device to dispense the dye bath on the textile support, and at least one squeezing device; a second shaped cavity containing the dye bath having a watertight function between the tank and the surrounding environment; and a second internal partition wall, which is immersed in the lower part in the dye bath of the second shaped cavity for helping the watertight.

9 Claims, 9 Drawing Sheets

(51) Int. Cl.

| | |
|---|---|
| ***D06B 3/04*** | (2006.01) |
| ***D06B 3/18*** | (2006.01) |
| ***D06B 5/08*** | (2006.01) |
| ***D06B 13/00*** | (2006.01) |
| ***D06B 15/02*** | (2006.01) |
| ***D06B 21/00*** | (2006.01) |
| ***D06B 23/02*** | (2006.01) |
| ***D06B 23/18*** | (2006.01) |
| ***D06B 23/22*** | (2006.01) |
| ***D06P 1/00*** | (2006.01) |
| ***D06P 1/22*** | (2006.01) |
| *D06B 19/00* | (2006.01) |
| *D06B 23/16* | (2006.01) |

(52) U.S. Cl.
CPC ..... *D06B 5/08* (2013.01); *D06B 13/00* (2013.01); *D06B 15/02* (2013.01); *D06B 21/00* (2013.01); *D06B 23/023* (2013.01); *D06B 23/18* (2013.01); *D06B 23/22* (2013.01); *D06P 1/0016* (2013.01); *D06P 1/228* (2013.01); *D06B 19/0005* (2013.01); *D06B 19/0052* (2013.01); *D06B 23/16* (2013.01)

(58) Field of Classification Search
CPC ..... D06B 15/02; D06B 21/00; D06B 23/023; D06B 23/16; D06B 23/18; D06B 23/22; D06B 19/0005; D06B 19/0052
See application file for complete search history.

(56) References Cited

U.S. PATENT DOCUMENTS

| | | | | |
|---|---|---|---|---|
| 8,060,963 | B2 | 11/2011 | Ronchi | |
| 8,956,466 | B2 * | 2/2015 | Blaiss | B08B 1/20 68/5 R |
| 2021/0189622 | A1 * | 6/2021 | Ronchi | D06B 23/18 |

FOREIGN PATENT DOCUMENTS

| | | | |
|---|---|---|---|
| EP | 1971713 | A1 | 9/2008 |
| EP | 3464702 | A1 | 4/2019 |
| WO | 2019142224 | A1 | 7/2019 |
| WO | 2020053677 | A1 | 3/2020 |

* cited by examiner

| | First tank under nitrogen | Pneumatic foulard under nitrogen | Chamber for diffusion/fixing under nitrogen | Second tank under nitrogen | Dye bath volume (litres) | KW | Nitrogen dehumidification circulation unit |
|---|---|---|---|---|---|---|---|
| **EP 1771617 B1** | • Large volume<br>• Dyeing with lengthy immersion<br>• 1 partition wall<br>• Intermediate squeezing<br>• Hood | Yes | • Separate, vertical<br>• Heated cylinders<br>• Doors | • Small volume<br>• Dyeing with short immersion time<br>• 1 partition wall<br>• Hood | 1550 | 11 | Yes |
| **EP 1971713 B1** | • Large volume<br>• Dyeing with lengthy immersion<br>• 1 partition wall<br>• Intermediate squeezing<br>• Hood | Yes | • Separate, vertical<br>• Heated cylinders<br>• Doors | NO | 1450 | 5.5 | Yes |
| **EP 3464702 A1** | • Large volume<br>• Dyeing with lengthy immersion<br>• 1 partition wall<br>• Hood | Yes | • Separate, vertical<br>• Doors | • Variable volume<br>• Dyeing with minimum or maximum immersion<br>• 1 partition wall<br>• Hood | 1800 | 11 | Yes |
| **Dyeing apparatus 10** | • Single tank<br>• Small volume<br>• Bathing for very brief immersion<br>• Dyeing with cascade sprayers<br>• 2 partition walls<br>• Intermediate squeezing<br>• Lids | NO | • Incorporated in each dyeing section, flat | NO | 380 (approximately 70% less) | 5.5 | NO |

*Fig. 9*

MULTI-SECTION APPARATUS FOR DYEING, IN AN INERT ENVIRONMENT, OF FABRICS AND YARNS, WITH INDIGO AND OTHER REDUCTION DYES

TECHNICAL FIELD

The present invention relates in general to a dyeing apparatus, and in particular to a multi-section apparatus for dyeing in an environmentally sustainable manner, with indigo and other reduction dyes, of yarns and fabrics. More particularly, the present invention relates to a multi-section apparatus for continuous dyeing of chains of warp yarns for denim fabrics and/or of weft-warp and knitwear fabrics.

BACKGROUND

The present invention also relates to the implementation of an improved dyeing method, which makes it possible to obtain simply and rationally qualitative, ecological and economical results which are improved in comparison with the prior art. More particularly, the present invention relates to an apparatus which is extremely simple, rational, advantageous and economical, and can be used in one or more types of continuous dyeing lines and machines, in flat, rope, loop systems, or discontinuously, for ecologically sustainable dyeing, in an inert environment, with indigo and other reduction dyes, using baths with a low and/or high concentration and a low or high temperature, of warp chains for denim fabrics. For the sake of greater descriptive clarity and ease of understanding, the present invention will be described by way of non-limiting example, with reference only specifically to continuous dyeing, in a flat system, of warp chains for denim fabrics.

Denim is the particular fabric used to manufacture jeans, garments which are popular because they are associated with a young, sporting, rebellious, convenient and happy image. In fact, they are garments for everyone and for any activity. It is estimated that annually, throughout the world, approximately five thousand million pairs of jeans are produced, which makes denim the leader of the largest-scale worldwide fabric production.

The success of the combination of denim and blue jeans is derived from dyeing of the warp of this fabric with indigo. Indigo is one of the oldest dyes, which is not easy to apply to cotton for which it has low affinity, but which has a unique characteristic which gives the fabric, and consequently the finished garment, an appearance which is shiny and pleasing in the long term. In fact, blue jeans are valued for their typical navy-blue shade, which, as a result of repeated washing operations, gradually assumes a lighter shade, until a bright blue is obtained. As far as it is known, no dye other than indigo has similar properties. After many washing operations, other types of dyes tend towards a dirty grey, or stain the white weft yarn with an unattractive blue/greyish colour. This particular feature, together with that impression of lived-in clothing, taking the form of abrasion in the most exposed areas and creating a flexible effect on the body of people wearing it, constitutes the attraction of blue jeans, which, when produced and treated in many ways, are and will remain, the most-sold item of clothing in the world.

One of the characteristics of indigo dye, which makes it unique, is the particular dyeing method required for its application to cotton yarn. This dyeing method has remained virtually unchanged from the times of the vegetable dye up to the present, over 100 years since it was synthesised. Because of its relatively small molecule and its low affinity with cellulose fibre, in order to be applied indigo dye must not only be reduced in an alkaline (leuco) solution, but also needs to be subjected to a plurality of impregnations alternating with wringing and subsequent oxidation in air. In practice, a medium or dark shade is obtained only by subjecting the yarn to a first dyeing operation (impregnation, squeezing, oxidation) followed immediately by identical over-dyeing operations which are all the more numerous, the darker the tones and the greater the stability of the colour required.

This particular dyeing method, which is typical of indigo dye, shows the enormous importance of complying with determined basic parameters relative to the times of immersion in the tank and oxidation. This is in order to allow the dye to be impregnated and dispensed uniformly in the cortical or surface layer of the yarn (ring dyeing) and, after perfect squeezing, to be oxidised completely before entering the next tank, so as to be able to "enhance", i.e. intensify, the colour shade.

However, as well as being affected by these parameters, continuous dyeing with indigo is also affected by many other factors relating to the various physical-chemical contexts specific to each individual system, as well as to the environmental conditions where the system itself is installed, such as temperature and relative humidity of the air, bracing, altitude, etc. In addition, the different dyeing conditions (such as the number of tanks, their capacity, pick-up, type and speed of circulation of the dye bath, type and precision of the systems for automatic dosing of the dye, the sodium hydrosulphite and the caustic soda, etc.) and the different conditions of the dye bath (such as temperature, concentration, pH, Redox potential, etc) not only have a determining effect on the dyeing results (such as the greater or lesser intensity of shade, the stability, the corticality, etc.), but in combination with the various operations of pre-treatment (fulling, pre-dyeing, etc.) and post-treatment (over-dyeing, fixing, etc.) also contribute substantially to determining the final appearance of the clothing after the various treatments of washing and finishing to which it is normally subjected. It should also be specified that, contrary to other classes of dyes, for which the affinity for cotton increases as the temperature increases, in the case of indigo, the affinity and intensity of the colour, this intensity being caused by greater corticality of the dye, increase as the temperature decreases.

Continuous dyeing of the warp chains for denim fabrics is carried out mainly according to two systems, i.e. according to the so-called "rope" and the so-called "flat" or "wide" system. Although the above two systems differ substantially from one another, they are however combined, in the case of dyeing with indigo, by the use of the same dyeing method, constituted substantially by three operative phases which are repeated several times, i.e. impregnation of the yarn with the reduced dye, squeezing to eliminate the excess dye bath, and oxidation of the dye by means of exposure of the dyed yarn to the air.

Typically and traditionally, dyeing with indigo of the warp chains for denim fabrics is carried out, both in the rope system and the wide system, in open tanks and at a low temperature. In detail, in the two systems, the plants for continuous dyeing with indigo are normally constituted by 3-4 pre-treatment tanks (absorption, soaking, fulling, pre-dyeing, etc.), by 8-10 tanks for the actual dyeing, and by 3-4 post-treatment tanks (over-dyeing, fixing, washing, etc.). All the tanks are provided with a pneumatic squeezing unit in order to eliminate the excess dye bath, whereas the dye tanks are also provided with a set of cylinders for exposure to the air of 30-40 m of yarn for the oxidation of the dye.

The dye baths are of the open type, and in the "flat" system each has a dye bath capacity which varies between 1000 and 1500 litres, with a content of approximately 4-6 m of yarn. These quantities of dye bath determine the total volume of the dye bath in circulation in the system, which can therefore vary from approximately 8000 to 15,000 litres. The dye bath which is contained in each tank is continually recirculated in order to guarantee the homogeneity of concentration in each tank. This circulation is normally carried out by means of various known piping systems, with high capacity and low-lift centrifugal pumps, in order to avoid detrimental turbulence. The movement of the dye bath gives rise to continual replacement of the surface part of the dye bath itself, which is in contact with the air, the tanks being open at the top, and thus giving rise to the oxidation. The oxidation of the dye bath has the consequence of continual impoverishment of the reducing agents contained therein, i.e. sodium hydrosulphite and caustic soda, all the more so the higher the temperature of the dye bath is.

It is therefore the multiple phases of oxidation which contribute, in a manner far greater than described above, towards impoverishing the elements themselves (sodium hydrosulphite and caustic soda) of the dye bath with which the yarn is impregnated. These oxidation phases are an integral part of the dyeing cycle, and in practice they consist of exposure to the air, between one tank and another of the 8-10 dyeing tanks of the system, of approximately 30-40 m of yarn impregnated with leuco. Overall, the yarn is therefore exposed to the air for several hundreds of metres in the entire dyeing system.

On this basis, it is necessary to top up the dye bath continually with the quantities of sodium hydrosulphite and caustic soda destroyed by the above-described oxidations, so that this dye bath is constantly maintained in the optimum chemical conditions for the best dyeing performance, and in order to guarantee constant and reproducible results. These continual additions to the dye bath constitute a significant economical cost, they increase the salinity of the dye bath itself, with consequent dyeing problems, and also create substantial pollution of the final washing waters.

It will be appreciated that the dye bath must also have dye continually added to it, in conditions of concentrated leuco, in the quantity necessary to obtain the colour shade desired. For continuous automatic dosing of the indigo dye, the sodium hydrosulphite and the caustic soda, various systems can be used, such as dosing pumps, weighing, volumetric and mass systems, etc., all of which are known since they are also normally used in other textile processing. It will be appreciated that the greater the volume of the dye bath, the more time is needed to take a new dye bath to the chemical/dyeing equilibrium necessary in order to obtain the same colour shade constantly. The response time to any corrective interventions will be equally long, and this does not assist the operativity, the automatic control of the process, its repeatability, and above all obtaining of the required quality.

Another particular feature of indigo dye is due to the fact that the dye baths containing this dye are never replaced except to change colour shade. As previously stated, on the contrary, dye baths containing indigo are continually reused with the addition of sodium hydrosulphite, caustic soda and dye, in order to keep their chemical/dye equilibrium constant. Thus, for each of the different concentrations of the baths in use, each dyeing system has a container with the overall capacity of all of the tanks.

For quality purposes, it is of the greatest importance to succeed in keeping the physical-chemical conditions of the dye bath constant for the entire time necessary to dye the whole batch of yarn. On average, the time varies between 5 hours and 30 hours, depending on the length of the yarn chain and the dyeing speed. However, despite continual mechanical and hydraulic improvements of the dyeing systems and help from sophisticated control and dosing systems, as a result of the large volumes involved, and the many causes described above, which, individually or in association with one another combine to create undesirable variations of the dye bath conditions, continuous dyeing with indigo continues to be a complex operation.

However, in addition to the above-described factors, in the flat dyeing system, which is preferred for the many advantages it has compared with the rope system, the length of the yarn passing in the line, i.e. the dyeing machine plus the sizing machine, can reach approximately 500-600 metres. This is a very rational dyeing system, which however has an economical disadvantage as a result of the quantity of yarn which is lost at each change of batch. In fact, all of the aforementioned quantity of yarn, which constitutes the tail of the batch of yarn, dyeing of which is finished, and which remains in the system after the system has stopped, must be considered wasted, since it is not uniformly dyed. Similarly, also the same quantity of yarn which constitutes the beginning of the new batch, and which, connected to the tail yarn, replaces this yarn in the course of the dyeing system (an operation which is carried out at low speed for technical and safety requirements), is not uniformly dyed, and must therefore be eliminated.

However, in the entire clothing industry, jeans also hold the unfortunate record of being the garment which gives rise to the worst environmental and social impact. The production cycle of blue jeans, from growing the cotton until the point of sale is reached, in fact requires very high levels of water and energy consumption, as well as the use of chemical substances in various production stages. It is thus apparent that the most pollutant and characterising operation of the entire production cycle of denim fabric is that of continuous dyeing with indigo dye and/or other reduction dyes, of the warp yarn chains before they are put on a frame for production of the fabric. In fact, classic denim is produced by weaving pre-dyed cotton threads. In particular, only the warp is dyed, whereas the weft is used untreated.

Unfortunately, throughout the world, the recurrent economic crises, commercial wars with embargoes and customs duties, the various social and political problems, pandemics, etc., are the cause of recessions which contribute to general impoverishment leading to reduction of purchasing power. These factors and others, not least the ever greater demand for ecologically sustainable products, are contributing to the inevitable decrease in profit, and therefore to a need for substantial changes in the denim production line. Furthermore, from a mere, highly standardised work garment, jeans have gradually undergone continual development until they have become a very important fashion item which constantly requires diversification of the production of the denim fabric, produced in different weights, with different weaves, using yarns with various counts, made of cotton or mixtures and other fibres, in many colour shades, and with many final treatments; to summarise, they have become highly diversified. For these reasons, denim producers are therefore obliged not only to increase and diversify continually the number of types of fabrics to be provided, but also to make them faster, in increasingly short lengths and at ever lower prices, with significant erosion of the profitability.

Never as much as at present, in a context which is so globalised, has innovation to reduce consumption of energy, chemical products and particularly water, and consequently also to reduce production costs, been such a strategic imperative, which is essential to keep or win market positions in the industry, and to overcome situations of competitive disadvantage. This involves innovations concerning not so much the product or the materials as such, but the production method. In the light of the above information, it is apparent that denim producers are now faced with the indispensable economic and moral need to change the production system, as well as to innovate their traditional dyeing machinery in the least costly way possible, in order to reduce the consumption of energy, water and chemical products, so as to minimise the waste. In other words, denim producers need to do everything possible to present a renewed, lower cost, more economical product, but which at the same time is ecological and complies with environmental sustainability, a subject which is the focus of increasingly great attention throughout the world. As far as ecology is concerned, it is not improbable, indeed it has been requested, and is considered desirable by many consumer protection bodies, that there should soon be an international law imposing a drastic reduction of consumption, as well as compliance with precise standards aimed at protecting health and the environment.

In the specific field of continuous dyeing with indigo of warp chains for denim fabrics, dyeing apparatuses have already been produced which partly fulfil said requirements. These dyeing apparatuses, which however have so far been produced in small numbers, since they are complex and have a high cost, are described in patent documents EP 1771617 B1 and EP 1971713 B1 in the name of the same applicant, as well as in patent document EP 3464702 A1. The dyeing apparatuses which operate in this working condition, i.e. in an inert environment, preferably under nitrogen, in fact make it possible to eliminate many problems of the traditional dyeing system, compared with which, since they can operate with baths at a higher concentration, have not only the advantage of being able to decrease the number of dye tanks, thus reducing the space required and waste, but above all the advantage of reducing drastically (by 50% to 80%) the consumption of caustic soda and sodium hydrosulphite. Also, since there is better fixing of the dye on the yarn, a substantial saving in washing water is also obtained. Furthermore, in an inert environment (preferably under nitrogen) the chemical reduction of the indigo is total and perfect and the leuco is broken down into particles with nanometric dimensions, which increase the dyeing capacity thereof.

This increased dyeing capacity of the leuco permits better penetration and fixing on the fibre compared with the traditional dyeing system in air, with advantageous dyeing results in terms of stability, intensity and brightness, which differences enhance the quality of the final fabric. Moreover, said technology has also shown that, in dyeing with dyes based on sulphur, those for the denim colours, which from the point of view of energy are the most costly since the dyeing is carried out at a high temperature, in particular dyeing with black, which is also used for pre-dyeing and over-dyeing, gives a better colour performance, which can be assessed visually at approximately 40%, with a clearly improved level of fixing and better brightness than the dyeing carried out on the traditional machines.

It is therefore logical that, in view of the many motives previously given, even if they are partly fulfilled by the dyeing apparatuses illustrated in the aforementioned patent documents, the sector of dyeing of warps for denim requires new machines with a more rational and simpler structure, but above all with the minimum investment possible, which machines can operate to a higher standard and far more economically. It is apparent that in order to fulfil these requirements it is necessary to have new dyeing apparatus which, compared with that according to the aforementioned patent documents, not only simplifies the structure, in order to reduce the initial investment, but also makes it possible to operate with a new dyeing method and with a drastically reduced volume of dye bath, so as to reduce the production costs substantially.

Document WO 2020/053677 A1 in the name of the same applicant, based on the concepts of the above patent documents, also illustrates a dyeing apparatus according to the preamble of claim 1. This dyeing apparatus is inserted in a multifunctional, ecological and economical system for dyeing of fabrics (preferably denim) discontinuously, reversibly, with alternating phases and in an inert environment, using indigo and other reduction dyes. By moving the fabric in two directions, this dyeing apparatus carries out the entire operative cycle autonomously (pre-treatments, dyeing and post-treatments) with the possibility also of carrying out a plurality of dyeing phases.

SUMMARY

The objective of the present invention on the other hand is to provide, in a simplified embodiment, a multi-section apparatus for ecologically sustainable dyeing, continuously or discontinuously, in an inert environment, with indigo and other reduction dyes, of the warp chains for denim fabrics in the flat, rope and loop systems, with the minimum economic commitment, which apparatus can resolve not only the disadvantages of the dyeing systems according to the prior art, but also improve the performance and operative flexibility thereof, in an extremely simple manner, and with a substantial reduction of the production costs.

In detail, an objective of the present invention is to provide, in a simplified embodiment, a multi-section apparatus for dyeing the warp chains for denim fabrics which, in one or more examples, can be used in the dyeing processes, continuously or discontinuously, with indigo and other reduction dyes, and which can reduce the number of tanks normally used in the dyeing lines according to the prior art, with the corresponding resulting ecological and economical advantages, but which can also operate such as to reduce the waste at each change of batch.

Another objective of the present invention is to provide, in a simplified embodiment, a multi-section apparatus for dyeing the warp chains for denim fabrics which, using indigo and other reduction dyes, makes it possible to carry out exclusive dyeing with high concentration baths, and also at a low and/or high temperature.

Another objective of the present invention is to provide, in a simplified embodiment, a multi-section apparatus for dyeing the warp chains for denim fabrics which permits dyeing with indigo and other reduction dyes in the technologically best conditions and which, compared with the dyeing systems according to the prior art, makes it possible to increase substantially the quantity of dye which is fixed on the fibre.

Another objective of the present invention is to provide, in a simplified embodiment, a multi-section apparatus for dyeing the warp chains for denim fabrics which permits dyeing with indigo and reduction dyes with a greatly reduced volume of dye bath, fed in the "NIP" of the cylinders which accompany the yarn, in an inert environment, by frontal cascade sprayers, in order to intensify the bath/fibre Interchange ("NIP" means the point of tangency between each cylinder which accompanies the yarn and the yarn itself at its entry around this cylinder).

Another objective of the present invention is to provide, in a simplified embodiment, a multi-section apparatus for dyeing the warp chains for denim fabrics which, by operating with a greatly reduced volume of dye bath, makes it possible to reach rapidly the dyeing equilibrium of this dye bath, and permits drastic reduction of the various chemical components thereof (caustic soda and sodium hydrosulphite), of the energy consumption, with a significant reduction of the production costs, and also recuperation of the dye bath for its reuse, in a conventional plastic tank, with a significant reduction of the investment costs compared with voluminous storage containers.

Another objective of the present invention is to provide, in a simplified embodiment, a multi-section apparatus which makes possible the greatest convenience and ease of operation and maintenance.

Another objective of the present invention is to provide, in a simplified embodiment, a multi-section apparatus which, with indigo and other reduction dyes, can be used both in the continuous or discontinuous dyeing lines of the warp chains for denim, and also in those for warp-weft and knitwear fabrics.

Another objective of the present invention is to provide, in a simplified embodiment, a multi-section apparatus for dyeing the warp chains for denim fabrics which, for dyeing with indigo and reduction dyes, uses under economically advantageous conditions both a system for cooling the dye bath, and an ultrasound generator in order to increase further the colour performance.

A further objective of the present invention is to provide, in a simplified embodiment, a multi-section apparatus for dyeing the warp chains for denim fabrics which can operate such as to be able to increase the present possible production variables.

Yet another objective of the present invention is to provide, in a simplified embodiment, a multi-section apparatus for dyeing the warp chains for denim fabrics which, for dyeing with indigo and other reduction dyes, makes it possible to increase the level of fixing of the dye on the fibre, with reduction of the consumption of washing water, such as to contribute to environmental sustainability.

These objectives according to the present invention are achieved using a multi-section dyeing apparatus as described in claim 1.

Further characteristics of the invention are disclosed by the dependent claims, which are an integral part of the present description.

In order to achieve said objectives, a series of studies and experiments have been carried out which fortunately resulted in the creation of a new, original and innovative multi-section apparatus for dyeing the warp chains for denim fabric, which not only fulfils fully the above requirements, but which, by applying a novel multiphase dyeing method, also makes it possible to achieve a very high colour performance. Substantially, this new apparatus for dyeing in an inert environment, preferably under nitrogen, with indigo and other reduction dyes, differs structurally from all the dyeing apparatuses of a known type in that it operates with a greatly reduced volume of dye bath, since it does not use full-volume tanks and lengthy immersion of the yarn, but a new, multiphase dyeing system with spraying, and in that it is structurally very simple, in a single piece, and all developed on a flat basis.

As far as multiphase dyeing is concerned, it is specified that this new and novel dyeing system is possible since it has been discovered, and has been confirmed experimentally that, under nitrogen, indigo dye is fixed and is enhanced continually after each immersion and/or spraying operation, even without the usual intermediate oxidation phase which is necessary in the traditional system in air. The first condition necessary for this to take place is that, after each of said phases, the yarn previously impregnated with leuco is not provided with the interstitial dye bath, in order to assist the bath/fibre interchange. The second condition necessary for this to take place is that, after the elimination of the interstitial dye bath, the yarn remains for a certain amount of time impregnated with leuco, in an inert environment, for diffusion/fixing of the dye, and so on for each subsequent immersion or spraying operation.

The possibility of adopting this new important operative method has made it possible to create a new and original multi-section apparatus for dyeing, in an inert environment, preferably under nitrogen, for the warp chains for denim fabrics, which apparatus, from the design, structural and operative point of view, is completely different from, and enormously simplified in comparison with, the dyeing apparatuses according to the prior art. Inter alia, in this new and original multi-section dyeing apparatus, operating in an inert environment like the dyeing apparatuses according to the aforementioned patent documents, the traditional dye tanks completely full of dye bath have been replaced by a single tank, virtually without dye bath, with various sections provided with cascade sprayers, with improvement of the dyeing performance, and above all a drastic reduction of the volume of the dye bath.

This new multi-section apparatus for dyeing in an inert environment not only fulfils fully the above-described expectations, but also improves substantially the results and the proclaimed advantages of the dyeing apparatuses according to the aforementioned patent documents. In fact, unlike the dyeing apparatuses according to the aforementioned patent documents, which are very cumbersome, and, as well as having one or two dye tanks with a large volume of dye bath, comprise a chamber for diffusion/fixing of the leuco, which chamber is separate and/or vertically elevated, the multi-section dyeing apparatus according to the present invention, with a revolutionary structural design, which is extremely simple and extends entirely flat, by applying the new improved dyeing method in a single tank, carries out the same functions more intensively and rationally, with further advantages and improved colour performance.

Substantially, the apparatuses for dyeing in an inert environment according to the aforementioned patent documents consist of one or two immersion tanks, all with an internal partition wall placed at the entry or at the exit for the yarn. In the first tank, which has a large dye bath capacity and also has a watertight function, lengthy immersion of the yarn in the dye bath takes place. After being squeezed strongly by means of a pneumatic pressure foulard, the yarn then goes into the second compartment, which is usually in the form of a vertical chamber with airtight lateral doors or openings, where it remains for a certain amount of time for the diffusion and fixing of the leuco absorbed on the yarn. Subsequently, the yarn exits or goes into the second tank, with a dye bath and immersion capacity lower than, or the same as, the first tank, for a second impregnation. The second tank also has a watertight function. Finally, the yarn which is exiting is squeezed again strongly by a second pneumatic pressure foulard, in order to proceed to the phase of oxidation on a set of cylinders placed in air. In practice, these dyeing apparatuses of a known type operate with one immersion or a maximum of two immersions, and thus without, or with a single, enhancement of the dye.

As indicated in the preamble with reference to the particular dyeing method required by indigo dye, i.e. a first dyeing operation followed by various over-dyeing operations, it is specified that the quantity of dye which enhances after each of these operations is relatively low, specifically because of the low affinity of indigo for the cotton fibre. Consequently, in order to improve significantly the colour performance of the above-described dyeing apparatuses of a known type, it is necessary to create a new dyeing apparatus which can operate with a plurality of over-dyeing operations, and thus with a plurality of colour enhancements, in order to be able to obtain strong colour shades.

The multi-section dyeing apparatus according to the present invention, which is preferably produced from a system point of view according to the embodiment with three dyeing sections shown in the appended FIG. 1, but can also be created according to other embodiments (shown in FIGS. 2-8), shares with those according to the aforementioned patent documents only the concept of operating in an inert environment, with the yarn entry and exit watertight. Structurally and functionally, the multi-section dyeing apparatus according to the present invention has on the other hand radical differences which, notwithstanding the drastic simplicity of this apparatus, not only make it extremely economical, but add to the preceding proclaimed advantages an improved colour performance, as well as providing further substantial quality, management and economical improvements. This has become possible in practice thanks to the advantageous discovery previously described, which makes it possible to use an innovative multi-section system for dyeing with spraying. These multi-dyeing operations contribute towards a significant increase in the quantity of dye which is fixed on the yarn by affinity.

In practice, it has been discovered that, under nitrogen, unlike the system for dyeing in air according to the prior art, it is not necessary for the yarn to remain immersed in the dye bath for a long time, since the dye bath sprayed in the individual dyeing sections in an inert environment remains in the leuco state, making it possible to continue the diffusion and fixing on the fibre. It will be appreciated that these multiple dyeing operations must be interspersed by light squeezing of the yarn in order to obtain the interstitial refilling of the dye bath, such that the dye can then be enhanced. This particular feature ensures that the apparatus according to the present intervention, with its multiple enhancements, has colour performance which is substantially better than that of the apparatuses according to the aforementioned patent documents.

The multi-section dyeing apparatus according to the present invention can be used in a single unit or a plurality of units, in the lines for continuous dyeing with indigo of the warp yarns in the various flat, rope and loop systems, with the great advantage, compared with the apparatuses according to the aforementioned patent documents, of simplifying enormously the structural complexity and reducing substantially the cost thereof. In addition, the apparatus adds to the proclaimed merits in common with the apparatuses according to the aforementioned patent documents an advantageous drastic reduction in the volume of the dye bath, and consequently its various chemical components, as well as in the consumption of energy and water, resulting in a substantial reduction in the production costs.

The multi-section dyeing apparatus according to the present invention is the result of experience and new experiments which have led to overthrowing of the dyeing method of the aforementioned patent documents, thus making it possible to be able to carry out whatever is ideal for each dyeing operation, i.e. to have the maximum bath/fibre contact time with the minimum possible volume of dye bath. In practice, as far as this specific sector is concerned, this is a technological and ecological turning point in order not to have to face up to tomorrow with the technology of yesterday. Compared with the system of the aforementioned patent documents, in this new system the volume of the dye bath is indicatively reduced by approximately 70%, and thus, for the same circulation pump, the bath/fibre interchange is quadrupled at least, thus guaranteeing improved dyeing, whereas the time taken to obtain the chemical equilibrium is drastically reduced. Likewise, there is a reduction in the capacities of the recuperation/storage containers for reusing the dye baths, thus permitting the use of traditional plastic tanks.

The aforementioned advantages can be obtained since, with the exception of the greatly reduced volume of the dye bath for the very short operations of bathing in the shaped initial and final cavities, the main purpose of which is to act as a hydraulic seal, in the multi-section dyeing apparatus according to the present invention the yarn is no longer dyed during lengthy immersions in the dye bath. On the contrary, the yarn is dyed by constant and uniform sprinkling of the dye bath directly in the "NIP", i.e. at the point of maximum hydrodynamic performance, and therefore with the greatest bath/fibre interchange, of one or more lower cylinders which accompany the yarn, in an inert environment, in each of the individual dyeing sections of which the apparatus can be constituted. These dyeing sections are separated from one another by a simple squeezer by weight, according to the new system of enhancement, wet product by wet product. In this respect, it is specified that for dyeing of yarns in ropes and fabrics, in view of their lower permeability compared with the conventional flat yarn mat, different positioning is preferably provided of the internal accompaniment cylinders, so as to create a path such as to permit the spraying of the dye bath alternately on both faces thereof.

The cascade dye bath sprayers, which are non-clogging and are placed fully-facing the yarn and/or the fabric, are supplied by a pump/filter circulation system which is connected to the central collection manifold of the dye bath. In the preferred configuration of the multi-section dyeing apparatus according to the present invention, shown in FIG. 1, this apparatus operates substantially as if there were three conventional lengthy immersions of the yarn and/or the fabric, thus with two enhancements of the dye, therefore providing a colour performance which is substantially better than that of the apparatuses according to the aforementioned patent documents.

The innovative dyeing method of the multi-section dyeing apparatus according to the present invention, constituted by a plurality of dyeing sections for spraying the yarn with fully-facing cascades of dye bath, alternating with simple squeezing by weight, in order to refill the interstitial bath and thus increase the diffusion, fixing and enhancement of the dye, including on the wet product, unlike the apparatuses according to the aforementioned patent documents, has made it possible to carry out the dyeing process in a single tank. The advantages are constituted by enormous structural simplification, as well as by the elimination of many components, such as the special, costly pneumatic foulard for the intermediate squeezing, which is motorised and operates under nitrogen, the subsequent complex and bulky chamber for diffusion/fixing of the dye, the heating cylinders, the second dye tank and the fan/battery unit for circulation/ dehumidification of the nitrogen (used to prevent dripping onto the squeezed yarn, but now no longer necessary since operation always takes place on the wet product). Further advantages are due to the reduction of the volume of nitrogen and, very importantly, to the totally flat extending of the multi-section dyeing apparatus according to the present invention, which is simple, convenient, rational, and above all has a significantly lower cost than the dyeing apparatuses according to the aforementioned patent documents.

In addition, the enormous reduction in the volume of dye bath compared with the conventional apparatuses for dyeing in air, and the drastic reduction of the volume of dye bath compared with the preceding dyeing apparatuses operating under nitrogen, allows the multi-section dyeing apparatus according to the present invention to be provided extremely economically with two useful and advantageous technical characteristics. A first advantageous technical characteristic consists in the addition, to the dye bath circulation container, of a unit to cool the dye bath to approximately 15° C., a characteristic temperature exclusive to indigo dye, at which the affinity thereof with cellulose fibre increases substantially, thus obtaining better colour performance. A second advantageous technical characteristic consists in addition, to the two, initial and final shaped bathing cavities, of an ultrasound generator in order to increase the bathing effect.

Its particular structural characteristics, together with the above features, provide the multi-section dyeing apparatus according to the invention not only with the greatest possible rationality and functionality, but also with exceptional operative flexibility. In fact, in addition to the operative variants possible also in the apparatuses according to the aforementioned patent documents, this new dyeing apparatus, in order to obtain the various levels of penetration and fixing of the dye which are required for the different final results on the garments made, can vary the number of sections of spraying to be used, vary the course of the yarn and/or fabric, or the bath/fibre contact time, vary the number of the sprayers used, the operative speed and the percentage of residual oxygen, as well as dye with a dye bath which is cooled and/or also activated by ultrasound, oxidise the dyed yarn immediately, at the exit from the foulard, by means of blowing of air supplied by fans and/or compressed air at a very low pressure, which does or does not have oxygen added to it, in order to block rapidly the degree of corticality obtained in dyeing, thus preventing the dye from penetrating further into the fibre during the subsequent path of oxidation in air. These new possible operative variations, individually or combined with one another, give rise to a series of different novels final results which increase greatly the range which can be offered for new types of denim and textile products, obtainable without chemical interventions, in an economical and ecological manner, fully in line with present and future expectations.

BRIEF DESCRIPTION OF THE DRAWINGS

The characteristics and advantages of a multi-section dyeing apparatus according to the present invention will become more apparent from the following description, provided by way of non-limiting example, with reference to the appended schematic drawings in which:

FIG. 9 is a table comparing the technical characteristics of the dyeing apparatus according to the present invention and those of the single dyeing apparatuses for the yarn warps for denim fabrics illustrated in the aforementioned patent documents.

DETAILED DESCRIPTION

Figure 1:
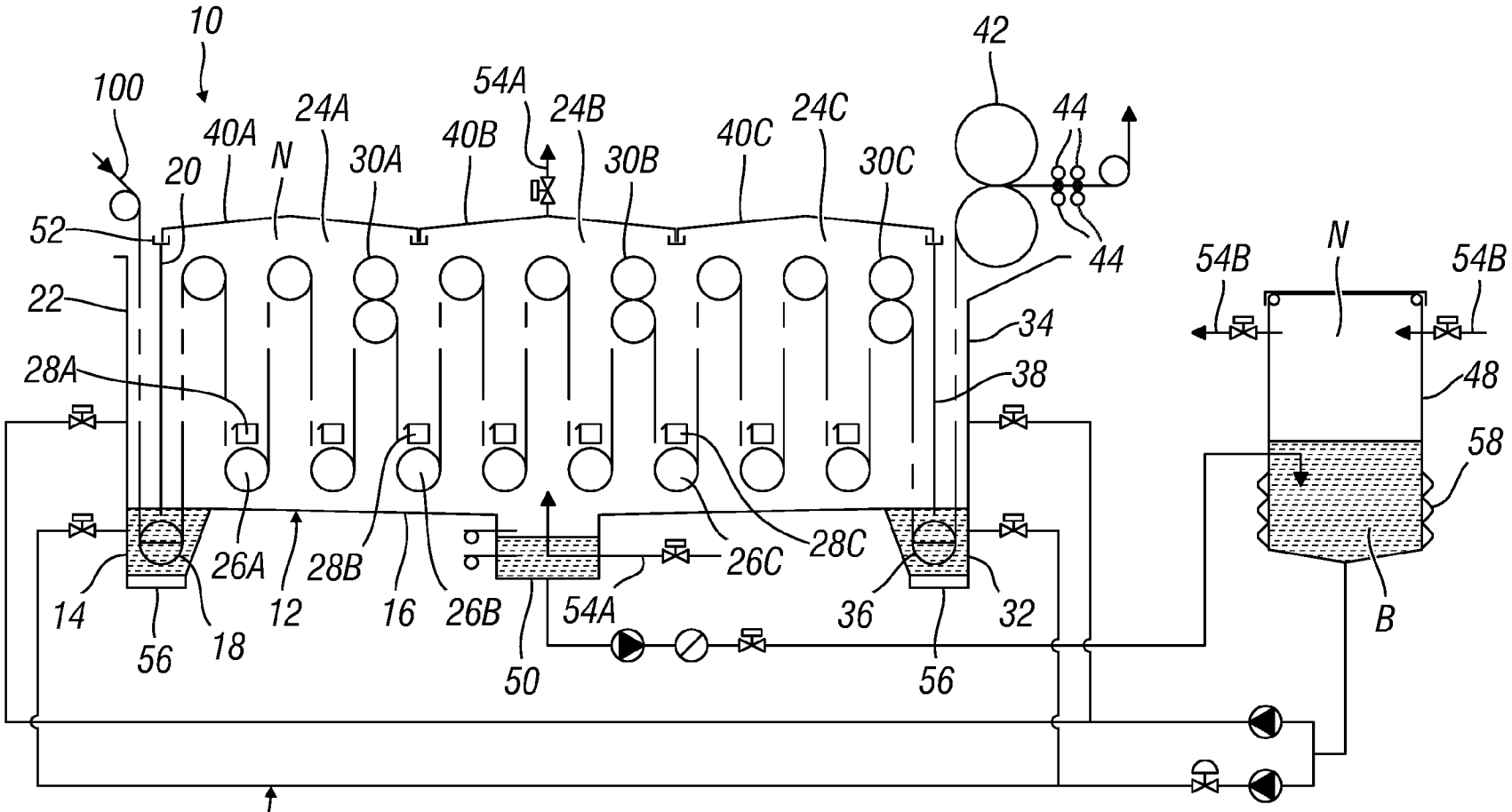
FIG. 1 is a schematic view in longitudinal cross-section of an apparatus according to the present invention for ecological and sustainable dyeing, in an inert environment, with indigo and other reduction dyes, of warp chains for denim fabrics and fabrics in the system continuously, wherein the apparatus is preferably provided with three dyeing sections.
Figure 2:
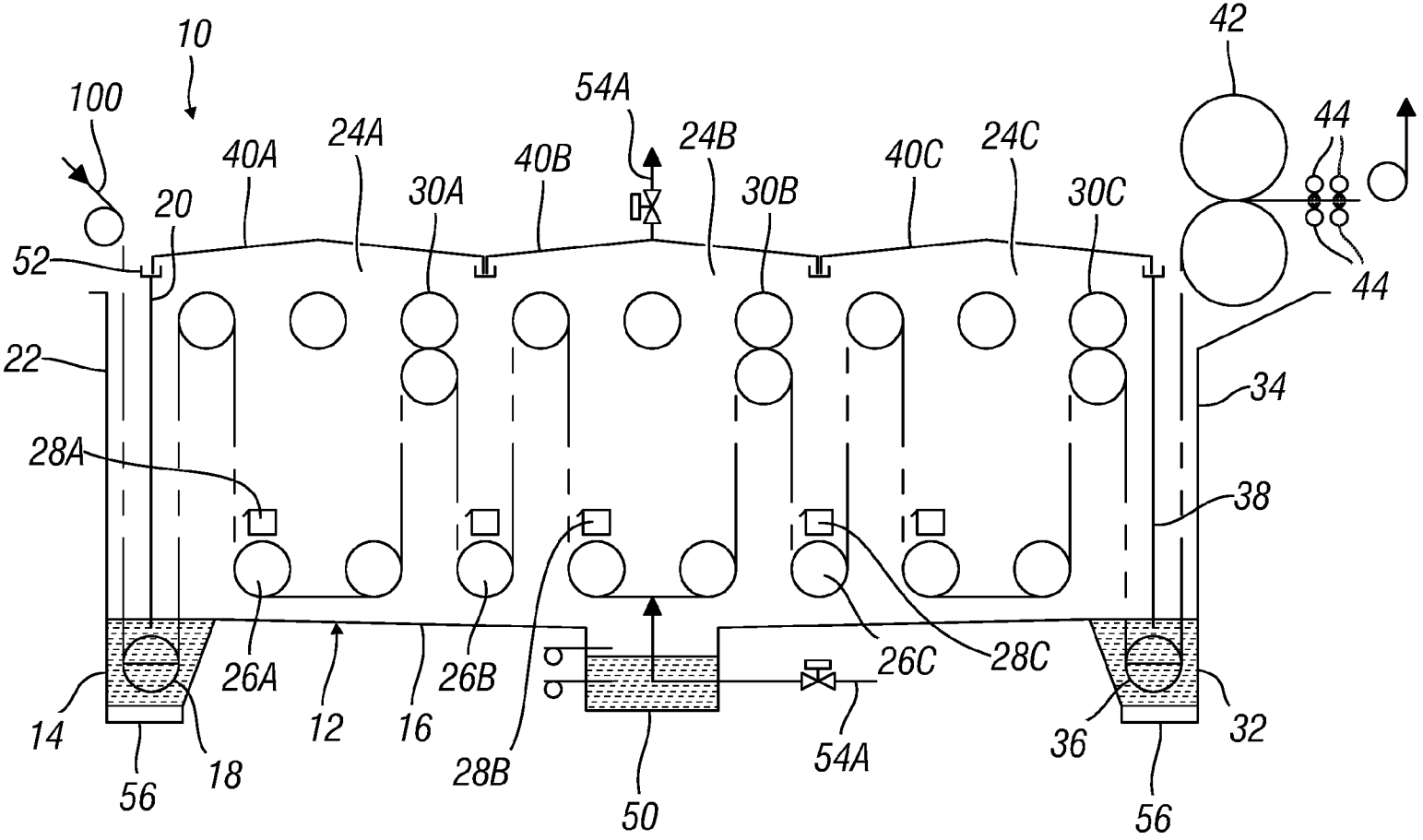
FIG. 2 is a schematic view, in longitudinal cross-section, of the single tank of the dyeing apparatus in FIG. 1, with a possible reduced course of the yarn and/or fabric.
Figure 3:
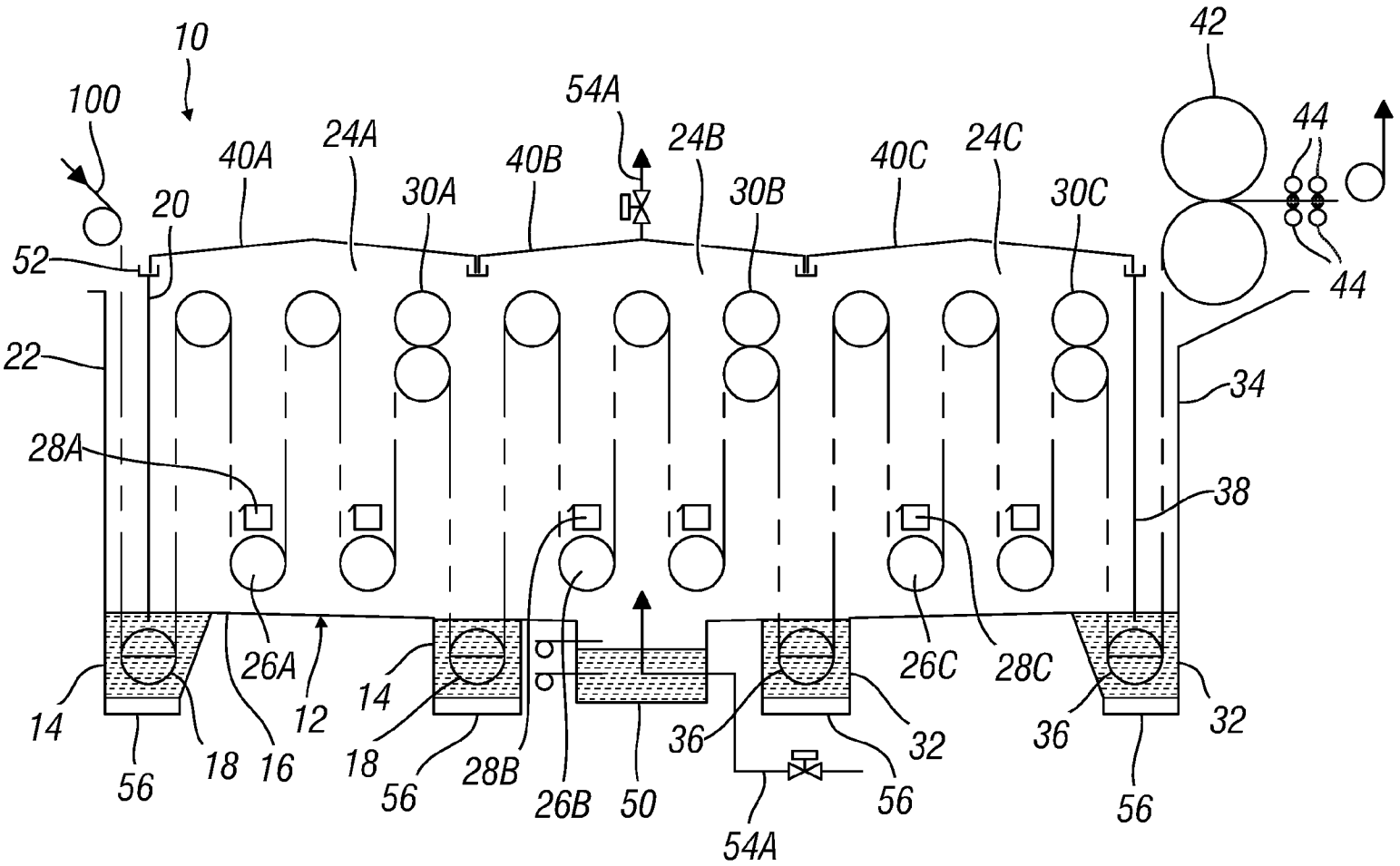
FIG. 3 is a schematic view, in longitudinal cross-section, of the single tank of the dyeing apparatus in FIG. 1, in a possible embodiment with addition, on the base wall, of a further two shaped bathing cavities.
Figure 4:
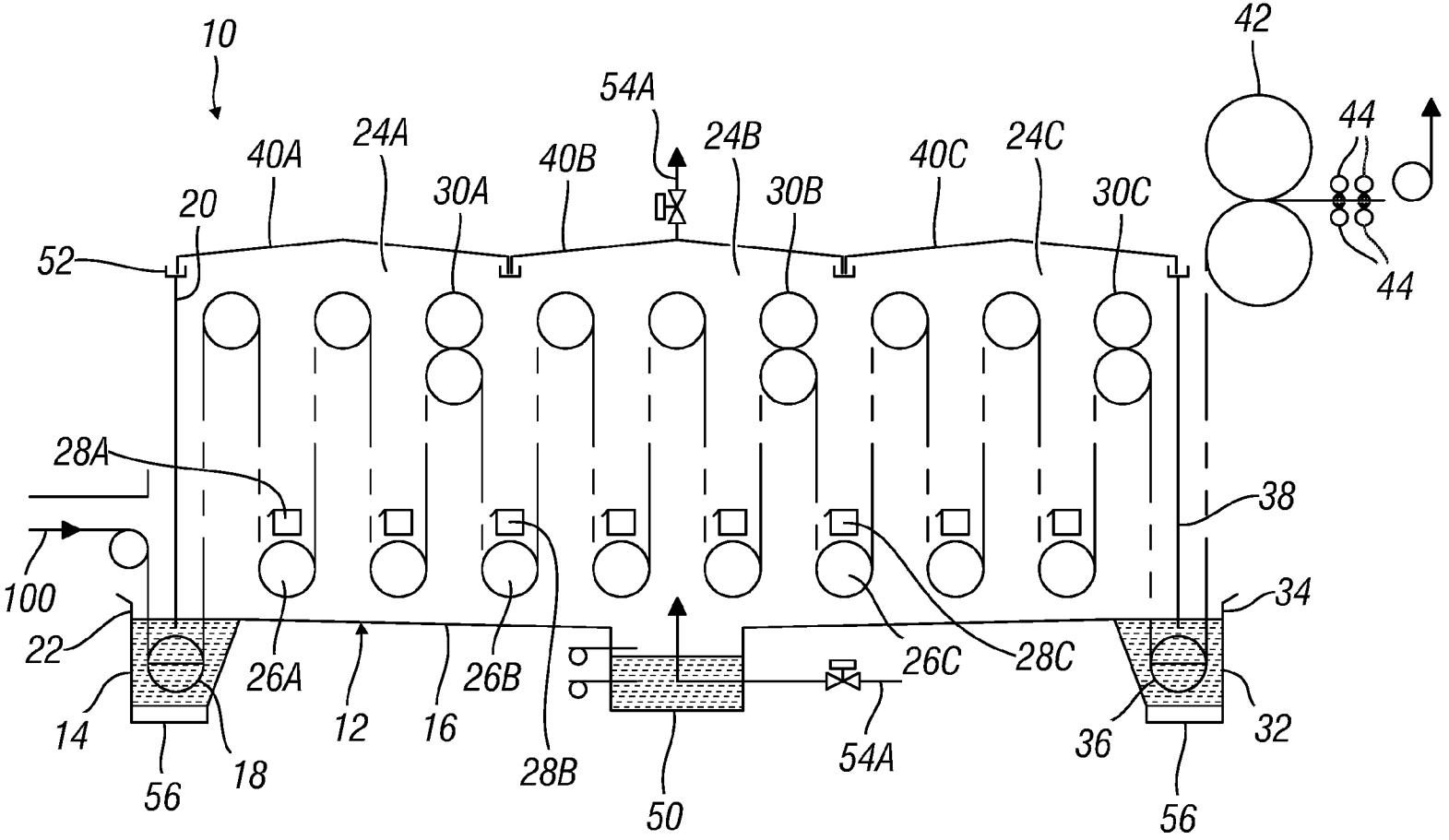
FIG. 4 is a schematic view, in longitudinal cross-section, of the single tank of the dyeing apparatus in FIG. 1, in a possible embodiment with the heads lowered.
Figure 5:
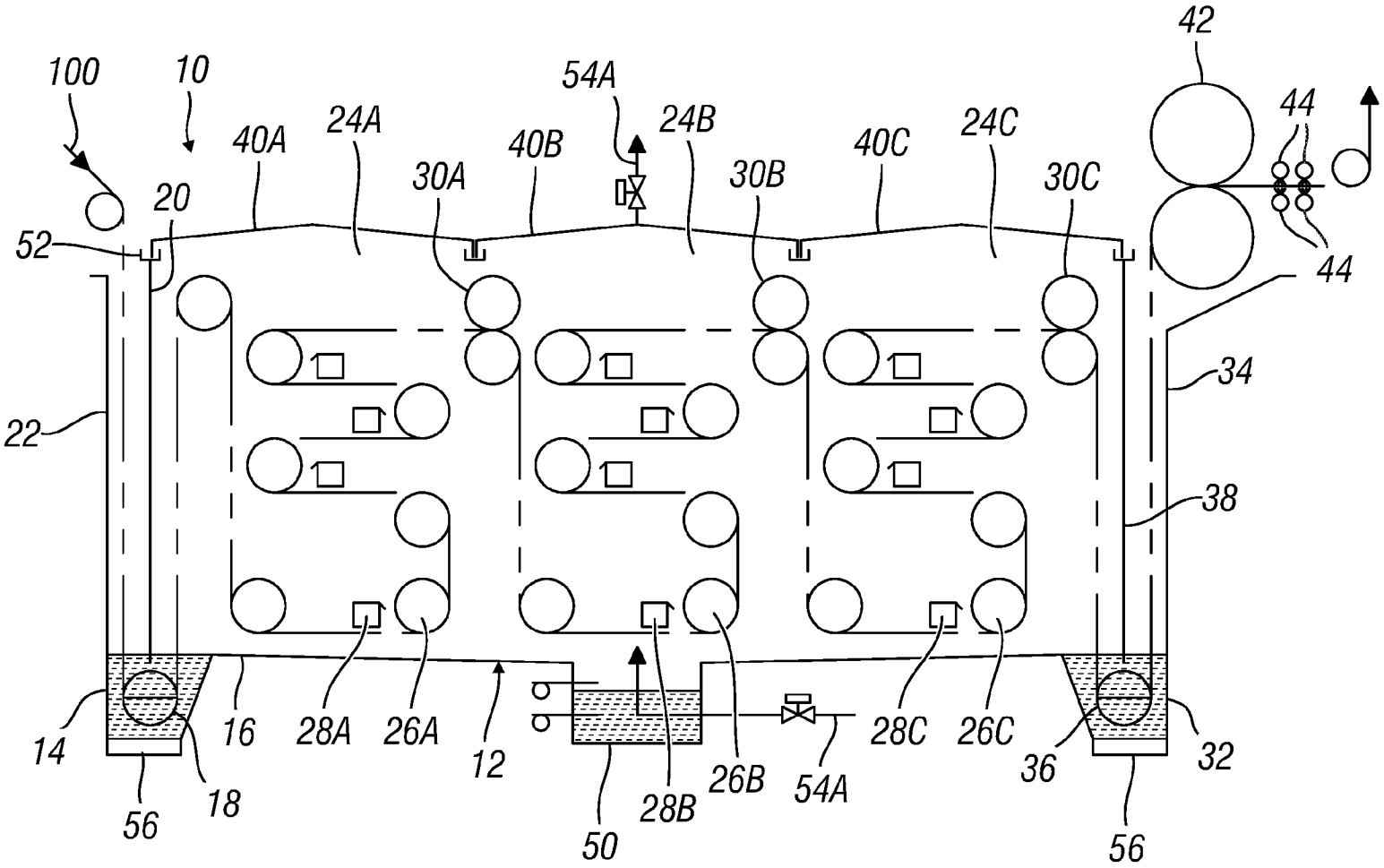
FIG. 5 is a schematic view, in longitudinal cross-section, of the single tank of the dyeing apparatus in FIG. 1, in a possible embodiment with a preferred path for yarns in ropes and fabrics, such that the spraying of the dye bath takes place on both faces thereof.
Figure 6:
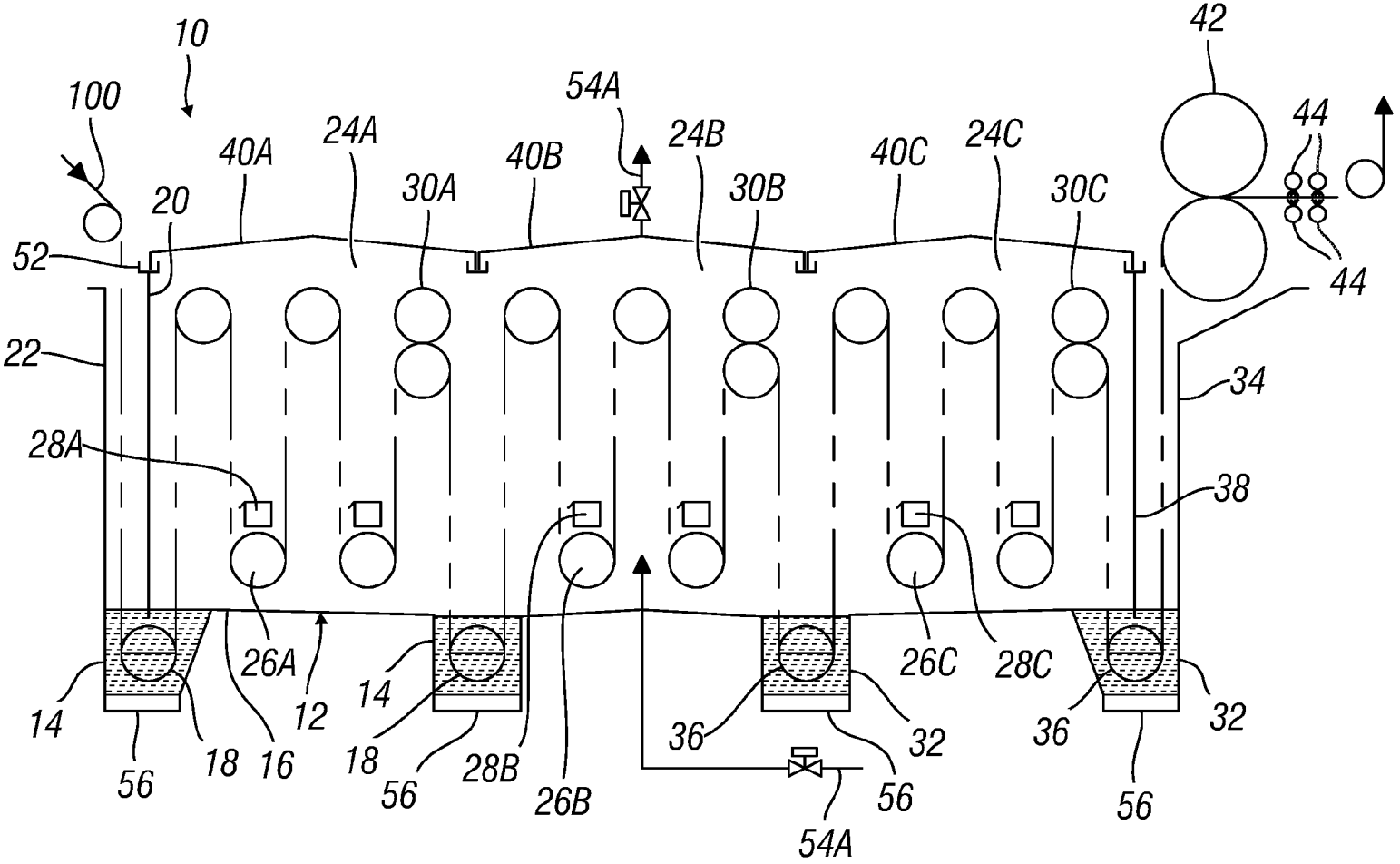
FIG. 6 is a schematic view, in longitudinal cross-section, of the single tank of the dyeing apparatus in FIG. 1, in a possible embodiment with the base wall provided with four shaped bathing cavities, and without the central manifold for collection of the dye bath.
Figure 7:
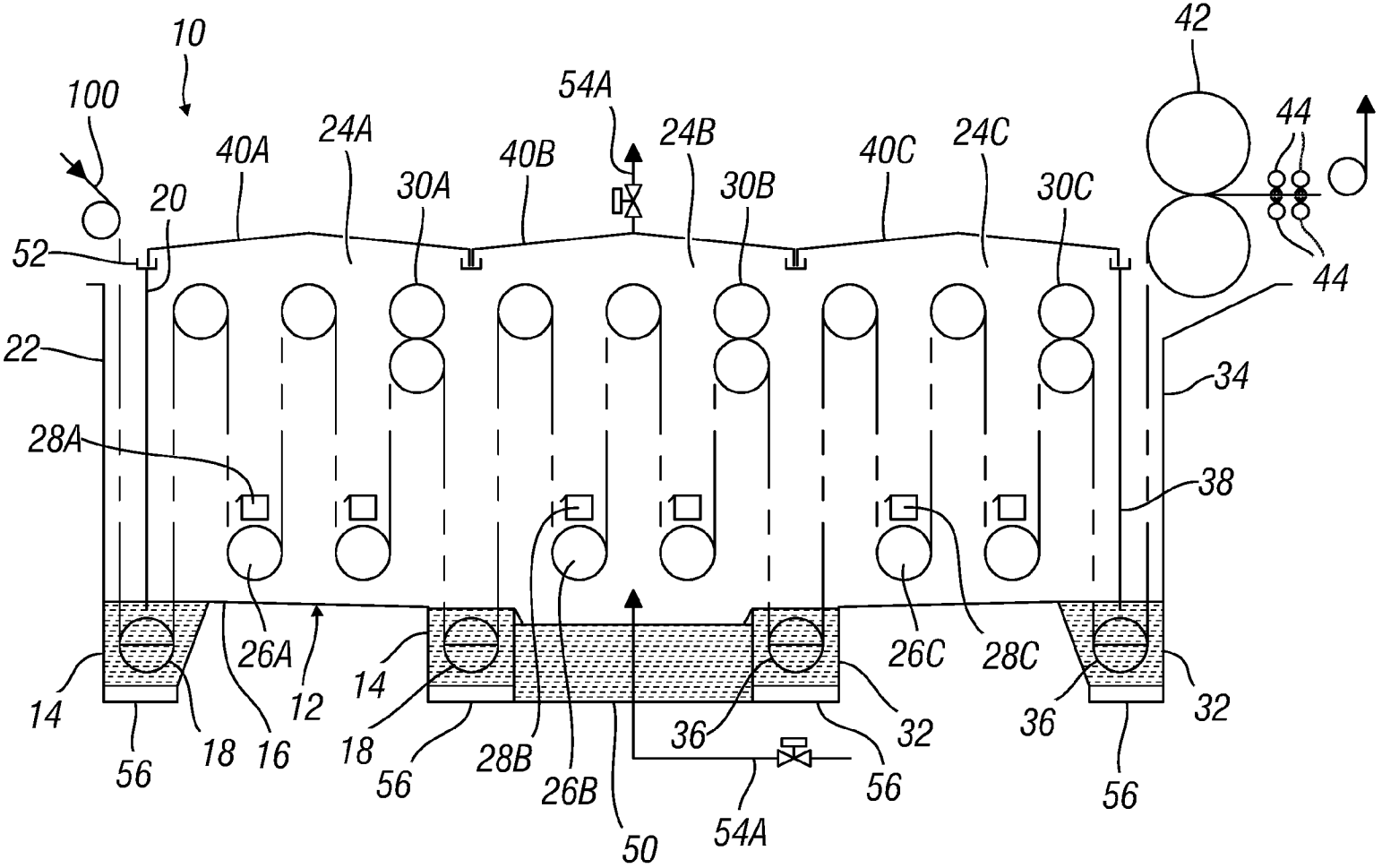
FIG. 7 is a schematic view, in longitudinal cross-section, of the single tank of the dyeing apparatus in FIG. 1, in a variant of the embodiment in FIG. 3.

It is specified that the following description and the appended figures do not illustrate, since they are well known to persons skilled in the art, numerous components, accessories and instruments with which all dyeing apparatuses are normally provided, such as for example regulators for the level of the dye bath, thermoregulation units, containers for preparation and recuperation of the dye bath and supply of auxiliary products, automatic dosing systems, command and control instruments, etc. It is also specified that the appended figures illustrate hydraulic circuits, provided with respective pumps and valves, which will not be described in detail hereinafter, since they are also well known to persons skilled in the art.

The figures show some possible embodiments of the apparatus for dyeing of yarns and/or fabrics according to the present invention, indicated overall with the reference number 10. The dyeing apparatus 10 is designed to carry out the dyeing, with a dye bath B which can preferably be based on indigo or other reduction dyes, of at least one continuous textile support 100 in the form of yarns and/or fabrics in general, such as for example the warp chains for denim fabrics. The dyeing apparatus 10 comprises a single tank 12 with a parallelepiped shape, inside which the textile support 100 is moved. The tank 12 is provided in its interior, in sequence, with:

at least one first shaped cavity 14, which is obtained near to the bottom wall 16 of the tank 12 and at a first head 22 of the tank 12, which is internally provided with at least one return roller 18 for the textile support 100 entering the tank 12 and is configured to be at least partially filled with a predefined quantity of dye bath B. This predefined quantity of dye bath B mainly has a watertight function between the surrounding environment and the tank 12; and at least one first internal partition wall 20, which is positioned near the first head 22 of the tank 12, which is integral with the side walls of said tank 12 and is configured to be immersed in the lower part in the dye bath B of the first shaped cavity 14 for helping the watertight function.

Inside the tank 12, downstream from the first shaped cavity 14 and the first internal partition wall 20, there are thus provided one first dyeing compartment 24A and at least one second dyeing compartment 24B, 24C within which the textile support 100 is not in any way immersed in the dye bath B. Each dyeing compartment 24A, 24B, 24C comprises at least one return roller 26A, 26B, 26C for the textile support 100, arranged to guide the movement of said textile support 100 vertically or horizontally within the respective dyeing compartment 24A, 24B, 24C, at least one dispensing device 28A, 28B, 28C, preferably of the cascade type, arranged to dispense the dye bath B on the textile support 100, and at least one squeezing device 30A, 30B, 30C with opposite idle rollers, placed at the exit of the respective dyeing compartment 24A, 24B, 24C and configured to dehydrate at least partially the textile support 100 leaving the respective dyeing compartment 24A, 24B, 24C and before entering the following dyeing compartment 24A, 24B, 24C or before leaving the tank 12.

In the embodiments of the dyeing equipment 10 in FIGS. 1 to 7, there are provided three distinct dyeing compartments 24A, 24B, 24C, inside the tank 12. In the embodiment of the dyeing apparatus 10 in FIG. 8 on the other hand, there are provided two distinct dyeing compartments 24A, 24B inside the tank 12. The number of dyeing compartments inside the tank 12 can in any case vary according to requirements.

Inside the tank 12, downstream from the dyeing compartments 24A, 24B, 24C, there are thus also provided in sequence:

at least one second shaped cavity 32, which is obtained near the bottom wall 16 of the tank 12 and at a second head 34 of the tank 12 opposite to the first head 22, internally provided with at least one return roller 36 for the textile support 100 leaving the tank 12 and configured to be at least partially filled with a predefined quantity of dye bath B. Similarly to the first shaped cavity 14 therefore, the predefined quantity of dye bath B in the second shaped cavity 32 has mainly a watertight function between the tank 12 and the surrounding environment; and at least one second internal partition wall 38, which is positioned near the second head 34 of the tank 12, which is integral with the side walls of the tank 12 and is configured to be immersed in the lower part in the dye bath B of the second shaped cavity 32 for helping the watertight function.

The dyeing apparatus 10 comprises at least one lid 40A, 40B, 40C, which engages in a watertight manner with the internal partition walls 20, 38 and the side walls of the tank 12, to close the tank 12 at the top and insulate the dyeing compartments 24A, 24B, 24C from the surrounding environment in a watertight manner. In the embodiments of the dyeing apparatus 10 in FIGS. 1 to 8, a single lid 40A, 40B, 40C is preferably provided for each of the dyeing compartments 24A, 24B, 24C contained in the tank 12.

Downstream from the tank 12, and thus outside this tank 12, the dyeing apparatus 10 also comprises at least one squeezing and pulling device 42 with opposite motorized rollers, which is configured to simultaneously pull the textile support 100 and extract excess liquid from this textile support 100 once it has exited from the tank 12. The dyeing apparatus 10 also comprises a hydraulic system 46, provided with at least one container 48, which is designed for the storage, circulation and supply of the dye bath B to each dispensing device 28A, 28B, 28C and inside each of the shaped cavities 14, 32 of the tank 12. The container 48 is advantageously in turn provided with means for thermal regulation 58 of the dye bath B. These thermal regulation means 58 can be constituted by one or more heating/cooling units, such as for example pipe coils, with cooling of the dye bath B.

The tank 12, with a parallelepiped form, preferably extends horizontally. Again preferably, the bottom wall 16 of the tank 12 is shaped such as to form, in addition to the first shaped cavity 14 and the second shaped cavity 32, which are in perimeter positions of this tank 12, also a central collection manifold 50 for the dye bath B. More specifically, on the bottom wall 16 of the tank 12, in a substantially intermediate position between the first shaped cavity 14 and the second shaped cavity 32, there is obtained at least one manifold 50 for collection of the dye bath B dispensed by the dispensing devices 28A, 28B, 28C of each dyeing compartment 24A, 24B, 24C. The collection manifold 50 is hydraulically connected to the hydraulic system 46 and to the corresponding container 48, such as to contribute to the recirculation of the dye bath B to the dispensing devices 28A, 28B, 28C.

As shown in the embodiments of the dyeing apparatus 10 in FIGS. 1-5 and 7, the bottom wall 16 of the tank 12 can preferably be provided with portions which are inclined relative to a horizontal plane, and descend from each shaped cavity 14, 32 towards the central collection manifold 50. By this means, the central collection manifold 50 can collect the dye bath B coming from the cascade dispensing devices 28A, 28B, 28C and from any overflows of the shaped cavities 14, 32, and then put it back into circulation through the hydraulic system 46.

Figure 8:
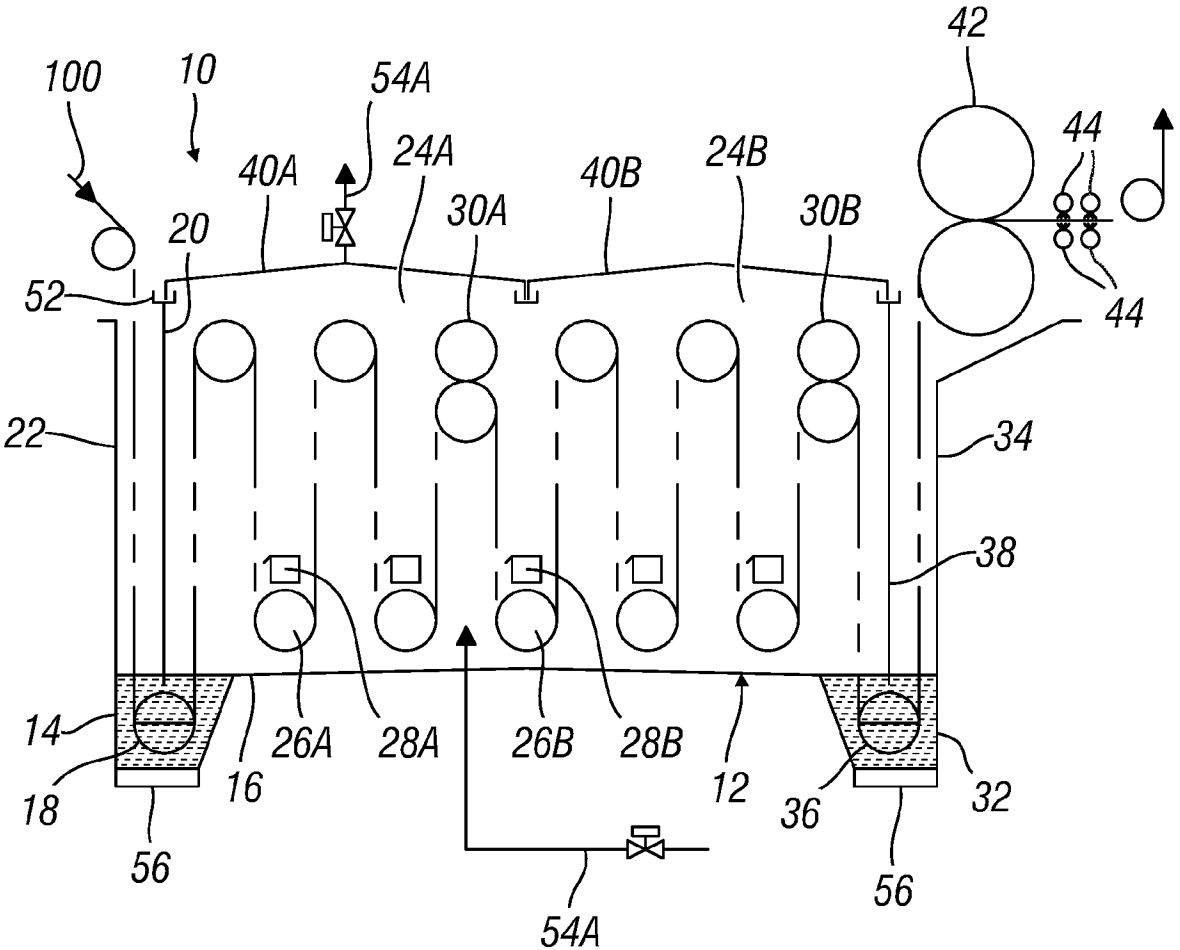
FIG. 8 is a schematic view, in longitudinal cross-section, of the single tank of the dyeing apparatus according to the invention, in a possible embodiment with two sections and without the collection manifold of the dye bath.

In FIG. 8, the bottom wall 16 of the tank 12 can preferably be provided with portions which are inclined relative to a horizontal plane, which, from the centre of the tank 12 itself, convey the dye bath B dispensed by the cascade dispensing devices 28A, 28B, 28C to the shaped cavities 14, 32 which are hydraulically connected to the hydraulic system 46.

In the embodiments of the dyeing apparatus 10 in FIGS. 1-3 and 5-8, the opposite heads 22, 34 of the tank 12 have a height which is substantially equal to the height of the corresponding internal partition walls 20, 38. In the embodiment of the dyeing apparatus 10 in FIG. 4, on the other hand, the opposite heads 22, 34 of the tank 12 are lowered relative to the corresponding internal partition walls 20, 38. In other words, in this embodiment, the opposite heads 22, 34 of the tank 12 have a minimum height necessary, together with the bottom wall 16, to close each shaped cavity 14, 32 of the tank 12.

Independently from the height of the opposite heads 22, 34 of the tank 12, each internal partition wall 20, 38 can be provided at the top with a respective channeled profile 52, which, by being connected to corresponding transverse channeled profiles of the tank 12 (not shown), form a watertight peripheral receptacle for the upper lids 40A, 40B, 40C, which are preferably removable from the tank 12. The hydraulic seals of the lids 40A, 40B, 40C can also be replaced by packing. As previously stated, by being immersed at the bottom of the dye bath B of the respective shaped cavities 14, 32, the internal partition walls 20, 38 ensure that, as well as bathing the textile support 100 entering into and exiting from the tank 12, these shaped cavities 14, 32 carry out the main function, in combination with an upper network of perimeter and transverse channels, of a hydraulic barrier which is necessary in order to make the tank 12 inert. In fact, the hydraulic system 46 can be provided with at least one circuit 54A, 54B for supply to each dyeing compartment 24A, 24B, 24C of an inert gas N, preferably constituted by nitrogen, such as to carry out the dyeing of the textile support 100 in an atmosphere which is completely free from oxygen, or with a predetermined and controlled residue of oxygen, in other words in a substantially inert environment. In detail, as shown in the appended figures, a first circuit 54A can be provided for supply of the tank 12, and a second circuit 54B for supply of the container 18.

Preferably, as shown in all the embodiments of the dyeing apparatus 10 in the appended figures, each dispensing device 28A, 28B, 28C is positioned at the point of tangency between a corresponding lower return roller 26A, 26B, 26C and the textile support 100 at the input, around this lower return roller 26A, 26B, 26C. In other words, each dispensing device 28A, 28B, 28C is advantageously positioned at the so-called "NIP" of the corresponding lower return roller 26A, 26B, 26C, i.e. at the point of maximum hydrodynamic performance, and thus the point of greatest interchange between the dye bath B and the textile support 100. Again preferably, each dispensing device 28A, 28B, 28C is constituted by a non-clogging cascade spraying device, which has a width substantially equal to, or greater than, the width of the textile support 100 moved within the tank 12.

The squeezing device 42 with opposite motorised rollers can preferably be constituted by a so-called foulard with pneumatic pressure. Downstream from this foulard 42, there are provided one or a plurality of devices 44 for blowing of air, which does or does not have oxygen added to it, in order to increase the level of oxidation of the textile support 100 once exiting from the tank 12 has taken place.

As previously stated, the dyeing apparatus 10 according to the present invention is advantageously provided with further devices which are configured to improve the dyeing capacity of the textile support 100. At least one of the shaped cavities 14, 32 of the tank 12 is in fact provided with a corresponding ultrasound generator 56, which is designed to increase the bathing effect of the dye bath B contained in this shaped cavity 14, 32. In addition, the container 48 is advantageously provided with means 58 for thermal regulation of the dye bath B, constituted for example by at least one set of pipe coils for cooling of this dye bath B, such as to increase further the colour performance of the dye bath B contained in the container 48, especially in the case when this dye bath B is based on indigo.

It has thus been shown that the multi-section dyeing apparatus according to the present invention fulfils the objectives previously set out. In practice, the multi-section dyeing apparatus according to the present invention, which is preferably configured to operate in an inert environment with indigo and other reduction dyes, and is provided with a single tank, is very simple, operatively very convenient and easy to control and maintain, but above all has a cost which is drastically lower than that of the apparatuses according to the aforementioned patent documents, it not only incorporates all the advantages proclaimed thereof, but adds to these others, as well as providing greater operative flexibility and better colour performance. A systematic comparison between the technical characteristics of a preferred embodiment of the multi-section dyeing apparatus according to the present invention and the corresponding technical characteristics of the dyeing apparatuses of the warp chains for denim fabrics according to the aforementioned patent documents can be seen in the table in FIG. 9.

With reference on the other hand to the multifunctional fabric dyeing system illustrated in document WO 2020/053677 A1, it is emphasised that the multi-section dyeing apparatus according to the present invention is, in fact, simply a dyeing tank, preferably for warp chains for denim fabrics, which operates continuously and in one direction, in an inert, ecological and economical environment. As a result of its particular characteristics, in a single unit or plurality of units, the multi-section dyeing apparatus according to the present invention advantageously replaces the eight or more dyeing tanks which normally constitute part of the traditional lines for continuous dyeing with indigo and other reduction dyes, the composition of which on average consists of 3-4 pre-treatment tanks, 8-10-dyeing tanks and 3-4 post-treatment tanks. The multi-section dyeing apparatus according to the present invention is not autonomous, or multifunctional, or two-way, but simply carries out continuously the single dyeing phase.

As a result of its particular structural and functional characteristics, the multifunctional dyeing system illustrated in document WO 2020/053677 A1 permits maximum operative flexibility, and many advantages, as well as fast deliveries of dyed fabrics, however always limited to batches of small lengths. On the other hand, the multi-section dyeing apparatus according to the present invention modernises, rationalises, and makes ecologically sustainable the dyeing of warp chains for denim fabrics on the traditional continuous dyeing lines, normally used for batches of yarn with long lengths. These apparatuses can be used both in newly constructed dyeing lines, and to modernise existing dyeing lines.

The structure of the multifunctional fabric dyeing system illustrated in document WO 2020/053677 A1 is quite complex, since this dyeing system comprises three distinct tanks, which can also be used individually and alternatively for different complementary treatments with different products, as well as using large volumes of dye bath. This requires appropriate hydraulic circuits, control instruments and supply containers for each tank, as well as their completion also with a foulard to pull the fabric at the entry and/or to dehydrate it between one tank and another, as well as rollers/unrollers and other complementary tooling. On the other hand, the multi-section dyeing apparatus for warp chains for denim fabrics according to the present invention has a very simple structure: in practice there is a single tank with a shaped base, which operates always and simply with a single dye bath dispensed by the cascade dispenser devices, and has a greatly reduced volume. This dye bath is supplied, kept in circulation and controlled by a single supply container.

In the multifunctional dyeing system for fabrics illustrated in document WO 2020/053677 A1 the phase of dyeing with indigo involves, alternatively, impregnation with lengthy immersion and a full volume of dye bath in the first tank, a lengthy time of stay in the second tank (for the diffusion/fixing of the dye) and a second impregnation with brief immersion, with a reduced volume of dye bath, in the third tank. The single tank of the multi-section dyeing apparatus for warp chains for denim fabrics according to the present invention operates on the other hand by using simply a new and innovative operative method, constituted by a plurality of sequential impregnations with the dye bath, interspersed by squeezing in order to refill the interstitial bath. There are no immersion tanks, or a chamber for diffusion/fixing of the dye.

In the multifunctional dyeing system for fabrics illustrated in document WO 2020/053677 A1 the dyeing operation, together with all the other complementary phases required by the operative cycle, is carried out by immersion of the fabric in the different dye baths necessary, which have a large volume. The single tank of the multi-section dyeing apparatus according to the present invention operates exclusively for the single dyeing phase of the warp yarn, but without the immersion of this yarn in the dye bath. In fact, the dye bath is uniformly supplied, at the "NIP" of all the lower accompaniment cylinders, by means of a plurality of free cascade sprayers, placed fully facing the yarn. As well as permitting an enormous reduction of the volume of dye bath, with all the inherent advantages thereof, this system permits a considerable increase in the recycling of the dye bath itself, to the advantage of the interchange with the fibre, with better penetration and regularity of the dye.

With reference to the embodiment of FIG. 8C of document WO 2020/053677 A1, it is specified that this embodiment has the same technical characteristics as the corresponding embodiments shown in all the other figures of this document. This embodiment shows simply a multifunctional system for dyeing of fabrics in the specific variant with a combined vertical/horizontal course of the fabric. This course is necessary in order to be able to carry out the dyeing on both faces of the fabric, by means of application of the dye with various systems which do not require immersion of the fabric itself in the tanks, as is the case on the other hand for all the other embodiments of the system. The purpose of this specific embodiment of the system is to be able to reduce drastically the volume of dye bath, with the undeniable advantages thereof. In any case, this specific embodiment also of the system according to document WO 2020/053677 A1, which may seem simpler than the other embodiments, also has its complexity and operative complication caused by the fact that, in order to be able to operate in the modes specified, it is necessary to use the dye bath simultaneously in two different physical forms, i.e. necessarily liquid, in the small head tanks for the watertightness, and in other forms for the dyeing, for which the system needs to be completed with specific supplementary apparatuses, such as generators and distributors under foam nitrogen, systems for pressurisation with nitrogen of the spray nozzles, devices for preparation and distribution under nitrogen of the spreading pastes, and scraping. As well as their high cost, these additional apparatuses require particular and constant operations of maintenance and above all cleaning, since they are subject to possible obstructions.

On the other hand, with reference to the multi-section dyeing apparatus for the warp chains for denim fabrics according to the present invention, the addition of the thermal regulation means 58 to the container 48 for circulation of the dye bath cannot be considered to be for the purpose specified in the system according to document WO 2020/053677 A1, but to take advantage of a particular characteristic of indigo dye, which, at a temperature of approximately 15° C. has the maximum affinity with cellulose fibre, and therefore makes it possible to obtain a substantially better colour performance. This is possible and advantageous, in view of the greatly reduced volume of the dye bath used in the individual tank of the multi-section dyeing apparatus according to the present invention. Again, because of the greatly reduced volume of dye bath used in the individual tank of the multi-section dyeing apparatus according to the present invention, it is then advantageous to apply an ultrasound generator 56 to the two shaped cavities 14, 32, in order to increase the bathing effect.

In short, the multi-section apparatus for dyeing of warp chains for denim fabrics according to the present invention, which apparatus is preferably configured to operate in an inert environment, using indigo and other reduction dyes, complies fully with the new industrial, creative, economical and ecological demands which require production changes, as well as economy of management and environmental sustainability.

The scope of protection of the invention is thus defined by the appended claims.

The invention claimed is:

1. An apparatus (10) for dyeing, with a dye bath (B), at least one continuous textile support (100) in the form of fabrics and/or yarns, the dyeing apparatus (10) comprising a parallelepiped-shaped single tank (12) within which said textile support (100) is moved, said tank (12) being internally provided, in sequence, with:

at least one first shaped cavity (14), which is obtained near a bottom wall (16) of said tank (12) and at a first head (22) of said tank (12), which is internally provided with at least one return roller (18) for said textile support (100) entering said tank (12) and is configured to be at least partially filled with a predefined quantity of dye bath (B) having a watertight function between a surrounding environment and said tank (12);

at least one first internal partition wall (20), which is positioned near said first head (22) of said tank (12), which is integral with side walls of said tank (12) and is configured to be immersed in a lower part in the dye bath (B) of said at least one first shaped cavity (14) for helping the watertight function;

one first dyeing compartment (24A) and at least one second dyeing compartment (24B, 24C) within which said textile support (100) is not immersed in said dye bath (B), wherein each dyeing compartment (24A, 24B, 24C) comprises:

at least one return roller (26A, 26B, 26C), arranged to guide the movement of said textile support (100) vertically or horizontally within the respective dyeing compartment (24A, 24B, 24C), at least one dispensing device (28A, 28B, 28C), arranged to dispense the dye bath (B) on said textile support (100), and at least one squeezing device (30A, 30B, 30C) with opposite idle rollers, placed at an exit of the respective dyeing compartment (24A, 24B, 24C) and configured to dehydrate at least partially said textile support (100) leaving the respective dyeing compartment (24A, 24B, 24C) and before entering the subsequent dyeing compartment (24A, 24B, 24C) or before leaving said tank (12);

at least one second shaped cavity (32), which is obtained near the bottom wall (16) of said tank (12) and at a second head (34) of said tank (12) opposite to said first head (22), which is internally provided with at least one return roller (36) for said textile support (100) leaving said tank (12) and which is configured to be at least partially filled with a predefined quantity of dye bath (B) having the watertight function between said tank (12) and the surrounding environment; and at least one second internal partition wall (38), which is positioned near said second head (34) of said tank (12), which is integral with the side walls of said tank (12) and is configured to be immersed in the lower part in the dye bath (B) of said at least one second shaped cavity (32) for helping the watertight function;

the dyeing apparatus (10) further comprising:

at least one lid (40A, 40B, 40C), which engages in a watertight manner with said internal partition walls (20, 38) and said side walls to close said tank (12) at a top and insulate said dyeing compartments (24A, 24B, 24C) from the surrounding environment in a watertight manner;

at least one squeezing and pulling device (42) with opposite motorized rollers, which is placed downstream of said tank (12) and is configured to simultaneously pull said textile support (100) and extract excess liquids from said textile support (100) once it has left said tank (12); and one hydraulic system (46), provided with at least one container (48), which is arranged to store, circulate and feed the dye bath (B) to said at least one dispensing device (28A, 28B, 28C) and inside said shaped cavities (14, 32), the dyeing apparatus (10) including one or more devices (44) for blowing air, which does or does not have oxygen added to it, provided downstream from said at least one squeezing and pulling device (42) with opposite motorised rollers, said one or more devices (44) for blowing air being designed to increase a level of oxidation of said textile support (100) once it has exited from said tank (12), in that at least one of said shaped cavities (14, 32) is provided with a respective ultrasound generator (56) which is designed to increase a bathing effect of said dye bath (B) contained in said shaped cavities (14, 32), and in that said container (48) is provided with at least one heating and cooling unit of said dye bath (B), such as to increase further a colour performance of said dye bath (B) contained in said container (48).

2. The dyeing apparatus (10) according to claim 1, wherein on the bottom wall (16) of said tank (12), in an intermediate position between said at least one first shaped cavity (14) and said at least one second shaped cavity (32), at least one collection manifold (50) for collecting the dye bath (B) dispensed by said at least one dispensing device (28A, 28B, 28C) is obtained, wherein said at least one collection manifold (50) is hydraulically connected to said hydraulic system (46) and said at least one container (48).

3. The dyeing apparatus (10) according to claim 2, wherein said bottom wall (16) is provided with inclined portions, with respect to a horizontal plane, coming down from each shaped cavity (14, 32) towards said at least one collection manifold (50), so that said at least one collection manifold (50) can collect the dye bath (B) coming from said at least one dispensing device (28A, 28B, 28C) and from any overflowing of said shaped cavities (14, 32) such as to put said dye bath (B) back into circulation through said hydraulic system (46).

4. The dyeing apparatus (10) according to claim 1, wherein said bottom wall (16) is provided with inclined portions, with respect to a horizontal plane, coming down from the centre of said tank (12) towards each shaped cavity (14, 32), so as to collect the dye bath (B) dispensed by said at least one dispensing device (28A, 28B, 28C) such as to put said dye bath (B) back into circulation through said hydraulic system (46).

5. The dyeing apparatus (10) according to claim 1, wherein each internal partition wall (20, 38) is provided at the top with a respective channelled profile (52) which, connecting to corresponding transverse channelled profiles of said tank (12), form a peripheral, watertight housing for lids (40A, 40B, 40C), which are removable with respect to said tank (12).

6. The dyeing apparatus (10) according to claim 1, wherein said hydraulic system (46) is provided with at least one circuit (54A, 54B) for feeding an inert gas (N), within each dyeing compartment (24A, 24B, 24C), so that the dyeing of the textile support (100) is carried out in a substantially oxygen-free atmosphere, or with a predetermined and controlled residue of oxygen, in a substantially inert environment.

7. The dyeing apparatus (10) according to claim 1, wherein each dispensing device (28A, 28B, 28C) is positioned at a point of tangency between a respective return roller (26A, 26B, 26C) and said textile support (100) entering around said return roller (26A, 26B, 26C), said point of tangency coinciding with a point of maximum hydrodynamic yield and therefore of greatest interchange between said dye bath (B) and said textile support (100).

8. The dyeing apparatus (10) according to claim 7, wherein each dispensing device (28A, 28B, 28C) consists of a cascade spraying device having a width which is equal to or greater than a width of said textile support (100) moved within said tank (12).

9. The dyeing apparatus (10) according to claim 1, wherein the at least one heating and cooling unit comprises pipe coils.

* * * * *